United States Patent [19]

Kobayashi et al.

[11] 4,119,822

[45] Oct. 10, 1978

[54] SMALL CURRENT SWITCH

[75] Inventors: Minoru Kobayashi, Hachioji; Shigeru Nemoto, Tachikawa, both of Japan

[73] Assignee: Olympus Optical Company Ltd., Tokyo, Japan

[21] Appl. No.: 788,886

[22] Filed: Apr. 19, 1977

[30] Foreign Application Priority Data

Apr. 27, 1976 [JP] Japan ..... 51/54191[U]

[51] Int. Cl.[2] ..... H01H 1/06; H01H 1/26

[52] U.S. Cl. ..... 200/246; 200/275

[58] Field of Search ..... 200/246, 275, 276, 283, 200/159 A

[56] References Cited

U.S. PATENT DOCUMENTS 3,860,776 1/1975 Lockard ..... 200/246 X 4,006,336 2/1977 Boyden ..... 200/246

*Primary Examiner*—Charles A. Ruehl

*Attorney, Agent, or Firm*—Lerner, David, Littenberg & Samuel

[57] ABSTRACT

A small current switch comprises a pair of juxtaposed, resilient conductive wires each carrying a coiled reinforcement formed intermediate its ends. One end of each wire is secured to an insulating base. One of the wires has its other end extending in a straight form while the other end of the other wire is bent substantially at right angles so as to extend in a direction perpendicular to the one wire, the free end of which is mounted on a switching member. The switching member may be moved to bring the connected wire into and out of electrical contact with the other wire.

3 Claims, 1 Drawing Figure

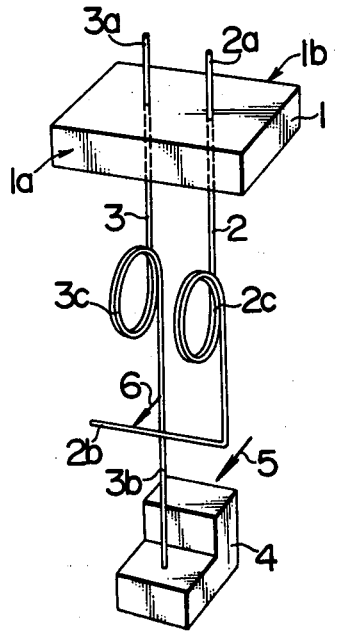
3a
2a
1b
1
1a
3
2
3c
2c
6
2b
5
3b
4

SMALL CURRENT SWITCH

BACKGROUND OF THE INVENTION

The invention relates to a small current switch comprising resilient wires, and more particularly, to switches of the aforesaid type which may be utilized in an electrical circuit of a miniature electrical instrument.

Microswitches, leaf switches and the like are used as electrical switches in miniature electrical instruments, but they are frequently unsuitable with respect to size, configuration or cost. While a switch of a miniature size is desired for switching a very small current, the prior art failed to meet such need. Though there has been provided a small current switch which comprises a resilient conductive wire used as a movable contact and which is resilient urged against or away from a stationary conductive terminal, the switching action has been achieved through the resilience of the single, straight wire alone, resulting in poor durability. Thus as the switch is frequently operated, the resilience is degraded and the wire assumes an arcuate form without restoring to its original form.

SUMMARY OF THE INVENTION

It is an object of the invention to provide a small current switch of an increased durability and switching reliability which comprises a pair of resilient conductive wires, providing a switching action similar to that of a torsion spring.

In accordance with the invention, the pair of conductive wires are each formed with a coiled reinforcement portion intermediate their ends. This reduces a degradation in the resilience of the conductive wires when subjected to undue stresses, as compared with straight resilient wires, and avoids wearing of the wires in the area where they are fixedly mounted, thus improving the durability of the switch. The switching action is achieved by the cooperation of the resilience of the respective conductive wires, added with the restoring action of the torsion spring formed by the coiled reinforcement, which assures a reliable engagement and disengagement between the wires. Since both wires engage each other at a point of contact formed at the intersection of mutually perpendicularly extending wires, an electrical contact is established in a reliable manner without influence of any dimensional error.

In addition to the pair of resilient conductive wires, the switch includes an electrically insulating base which supports the wires, and a switching member connected with one of the wires for movement thereof as the only remaining components, so that it can be assembled inexpensively and in a compact manner. Thus an optimum construction for a small current switch is provided.

BRIEF DESCRIPTION OF THE DRAWING

The single drawing is a perspective view of the small current switch constructed in accordance with the invention.

DETAILED DESCRIPTION OF PREFERRED EMBODIMENT

Referring to the drawing, there is shown an electrically insulating base 1, through which a pair of resilient conductive wires 2, 3 extend in parallel relationship with each other and are fixedly connected therewith. The ends 2*a*, 3*a* of the wires which extend above the base 1 provide electrical terminals for circuit connection. The base 1 is formed as a flat plate having a front and a rear end face 1*a*, 1*b*. It will be noted from the drawing that the wire 2 is located nearer the front face 1*a* than the other wire 3 to provide a clearance between their opposite free ends in order to form a normally open switch.

Each of the wires 2, 3 is formed with a coiled reinforcement portion 2*c* or 3*c* intermediate the ends thereof, which reinforcement may comprise a few turns coiled in the manner of a torsion spring. However, it is to be understood that in the free condition of the wire, the coiled reinforcement does not in any way bias the free end thereof. It will be noted that the planes of the coiled reinforcements 2*c*, 3*c* are parallel to each other.

The free end portion 2*b* of the wire 2 is bent substantially at right angles so as to extend in a direction perpendicular to the free end portion 3*b* of the other wire 3. It is to be noted that a clearance is normally left between the free end portions 2*b*, 3*b*. The extremity of the end portion 3*b* is fixedly connected with an electrically insulating switching member 4.

In use, when it is desired to close the switch thus constructed, the switching member 4 is moved in a direction indicated by an arrow 5. Thereupon, the straight end portion 3*b* of the wire 3 moves in a direction indicated by an arrow 6 into abutment against the end portion 2*b* of the wire 2, thus closing the switch. In the closed position of the switch, the end portion 2*b* of the wire 2 is urged by the coiled reinforcement 2*c* in the opposite direction from the arrow 6, thus reliably maintaining the electrical contact between the wires 2, 3, regardless of the exact position on the end portion 2*b* at which the straight wire end portion 3*b* engages the latter.

To open the switch, the switching member 4 may be returned or released from the force acting in the direction of the arrow 5, whereupon the resilience of the coiled reinforcements 2*c*, 3*c* restores the respective wires 2, 3 to their original positions where they are spaced apart, thus opening the switch.

While the described embodiment represents a normally open switch, a normally closed switch may be similarly constructed. In this instance, e.g., the end 3*b* may be crossed with the end 2*b*. The resilience of the coiled reinforcements 2*c* and 3*c* normally urges the end portions 2*b* and 3*b* into contact with each other. To open the normally closed switch, the switching member 4 may be moved in the direction of the arrow 5, thus moving the wire 6 in the direction of the arrow 6.

What is claimed is:

1. A small current switch comprising an electrically insulating base; a first resilient conductive wire having one of its ends secured to the base to provide a terminal for connection with an electrical circuit, the first wire being formed with a coiled reinforcement intermediate its ends and having its other end extending in a straight manner; a second resilient conductive wire having one of its ends secured to the base to provide another terminal for connection with an electrical circuit, the second wire being juxtaposed with the first wire and being formed with a coiled reinforcement intermediate its ends, the coiled reinforcement of the second wire being disposed in parallel relationship with that of the first wire, the other end of the second wire being bent substantially at right angles so as to extend in a direction perpendicular to the straight end of the first wire; and a switching member secured to the other end of the first wire for moving the first wire into and out of contact with the second wire.

2. The switch of claim 1, wherein the ends of said wires secured to said base are arranged in said base so that the free ends are displaced from one another when the switching member is in a first position and said free ends are engaged when the switching member is moved in a first direction against the resilience of the wire secured thereto.

3. The switch of claim 1, wherein the free ends of said wires secured to said base are arranged in said base so that the free ends engage one another when the switching member is in a first position and said free ends are disengaged when the switching member is moved in a first direction against the resilience of the wire secured thereto.

* * * * *